US005473352A

United States Patent [19]

Ishida

[11] Patent Number: 5,473,352

[45] Date of Patent: Dec. 5, 1995

[54] IMAGE FORMING DEVICE HAVING SHEET CONVEYANCE DEVICE

[75] Inventor: Kazuhito Ishida, Nagoya, Japan

[73] Assignee: Brother Kogyo Kabushiki Kaisha, Nagoya, Japan

[21] Appl. No.: 262,908

[22] Filed: Jun. 21, 1994

[30] Foreign Application Priority Data

Jun. 24, 1993 [JP] Japan ..... 5-179820

[51] Int. Cl.[6] ..... B41J 2/06

[52] U.S. Cl. ..... 347/55; 347/153

[58] Field of Search ..... 347/55, 139, 152, 347/153

[56] References Cited

U.S. PATENT DOCUMENTS

| | | | |
|---|---|---|---|
| 3,834,301 | 9/1974 | Croquelois et al. | 347/55 |
| 4,401,024 | 8/1983 | Frentress | 347/55 X |
| 4,682,188 | 7/1987 | Castellano | 347/8 |
| 5,229,794 | 7/1993 | Honma et al. | 346/154 |
| 5,231,427 | 7/1993 | Ohashi | 346/155 |
| 5,257,046 | 10/1993 | Schmidlin | 347/124 |
| 5,404,159 | 4/1995 | Ohashi | 347/55 |

*Primary Examiner*—Robert Beatty
*Attorney, Agent, or Firm*—Oliff & Berridge

[57] ABSTRACT

An image forming device for forming an image on a sheet. A pair of transport rollers are provided for transporting the sheet by their rotation so that the sheet exits from between the pair of rollers while substantially aligned with a tangent plane of both of the pair of rollers. An elongated chute is provided for guiding the sheet after the sheet exits from between the pair of transport rollers. The chute is supported so as to intersect the tangent plane to cross from one side of the tangent plane to another in the direction followed by the sheet. A toner control electrode is supported adjacent to the chute at its end opposite the transport rollers. A back electrode with an electrode tip is supported so that the electrode tip confronts the toner control electrode as separated by a space. The sheet is transported through the space as guided by the chute.

12 Claims, 3 Drawing Sheets

IMAGE FORMING DEVICE HAVING SHEET CONVEYANCE DEVICE

BACKGROUND OF THE INVENTION

1. Field of the Invention

The present invention relates to a image forming device and more particularly to the image forming device having a sheet transportation unit for transporting a sheet to be printed on past a print head.

2. Description of the Related Art

There has been known an image forming device having an elongated flat plate (hereinafter referred to as chute) for guiding a sheet to be recorded on. The chute is supported so as to run between a toner fixing device and a pair of rotatable transport rollers. An aperture electrode body and a back electrode with an electrode tip are supported near the center of the chute on opposite sides thereof. The back electrode and aperture electrode are positioned so that the aperture electrode and the electrode tip of the back electrode are separated by a space.

A sheet to be recorded on is transported between the pair of transport rollers by the rotation thereof. The thus transported sheet follows the chute toward the toner fixing device, thereby passing through the space separating the aperture electrode and the tip of the back electrode.

The space separating the aperture electrode and the tip of the back electrode is extremely narrow. Although actual values vary with the voltage applied to the back electrode, the space can be as narrow as 0.5 mm to 1 mm. To accurately feed the sheet through this space, the pair of transport rollers need to be as close to the aperture electrode and the back electrode as possible.

However, other components, such as those required for development processes, also must be positioned near the aperture electrode. This limits how close the pair of transport rollers can be positioned adjacent to the aperture electrode and the back electrode. Conventionally the chute is supported between the thermal fixing device and the pair of transport rollers so as to be substantially parallel to a direction tangential to both transport rollers. Because of this the sheet is unstably transported between the aperture electrode and the back electrode during printing.

Because the toner charged by and discharged from the aperture electrode body does not become fixed when it impinges to the sheet surface, the characters formed from toner on the surface of the sheet might be smudged if scraped against the aperture electrode body. The quality of printed characters can therefore suffer greatly. Additional components such as plate springs can be provided to support and stabilize the posture of the sheet, but adding new components increases costs.

SUMMARY OF THE INVENTION

It is therefore an object of the present invention to overcome the above-described drawbacks, and to provide an inexpensive image forming device that effectively uses the stiffness of the sheet to be printed on so that the sheet can be passed stably through the space separating a conductor electrode, of, for example, an aperture electrode, and a back electrode without contacting the conductor electrode thereby producing good quality printed images without smudges.

An image forming device according to the present invention includes a pair of transport rollers, an elongated chute, a toner control electrode, and a back electrode.

The pair of transport rollers are rotatably supported so as to be rotatable in opposite directions. The pair of transport rollers are for transporting the sheet therebetween by the rotation thereof so that the sheet exits from between the pair of rollers in a tangential direction while substantially aligned with a tangent plane of both of the pair of rollers.

The elongated chute is for guiding the sheet after the sheet exits from between the pair of transport rollers. The chute has at opposite ends thereof a roller end and a back electrode end. The chute is supported so as to intersect the tangent plane so that the roller end is on one side of the tangent plane in confrontation with a roller of the pair of transport rollers and so that the back electrode end is on another side of the tangent plane.

The toner control electrode is supported on the another side of the tangent plane adjacent to the back electrode end of the chute.

The back electrode has an electrode tip. The back electrode is supported adjacent to the back electrode end of the chute so that the electrode tip is on the another side of the tangent plane and is closer to the tangent plane than the toner control electrode and so that the electrode tip confronts the toner control electrode as separated by a space. The sheet is transported through the space as guided by the chute.

The chute preferably defines a chute plane which divides space into a toner control electrode side and another side. The toner control electrode is supported in the toner control electrode side. The back electrode is supported so that the tip electrode cuts across the chute plane and protrudes into the toner control electrode side.

It is preferable that the toner control electrode be formed with a plurality of apertures having axes. The apertures are aligned in the toner control so that their axes define an axis plane that is perpendicular to the chute plane. An angle formed between the axis plane and the tangent plane is preferably less than 90o and preferably corresponds to a space that encompasses the back electrode end of the chute section.

It is preferable that a toner supply roller is supported adjacent to the toner control electrode for supplying toner thereto. The toner supply roller is supported at a side of the toner control electrode opposite a side at which the back electrode is supported. The toner supply roller has an axis through which an axis plane passes. The axis plane is perpendicular to the chute plane. An angle formed between the axis plane and the tangent plane is preferably less than 90° and preferably corresponds to a space that encompasses the back electrode end of the chute section.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
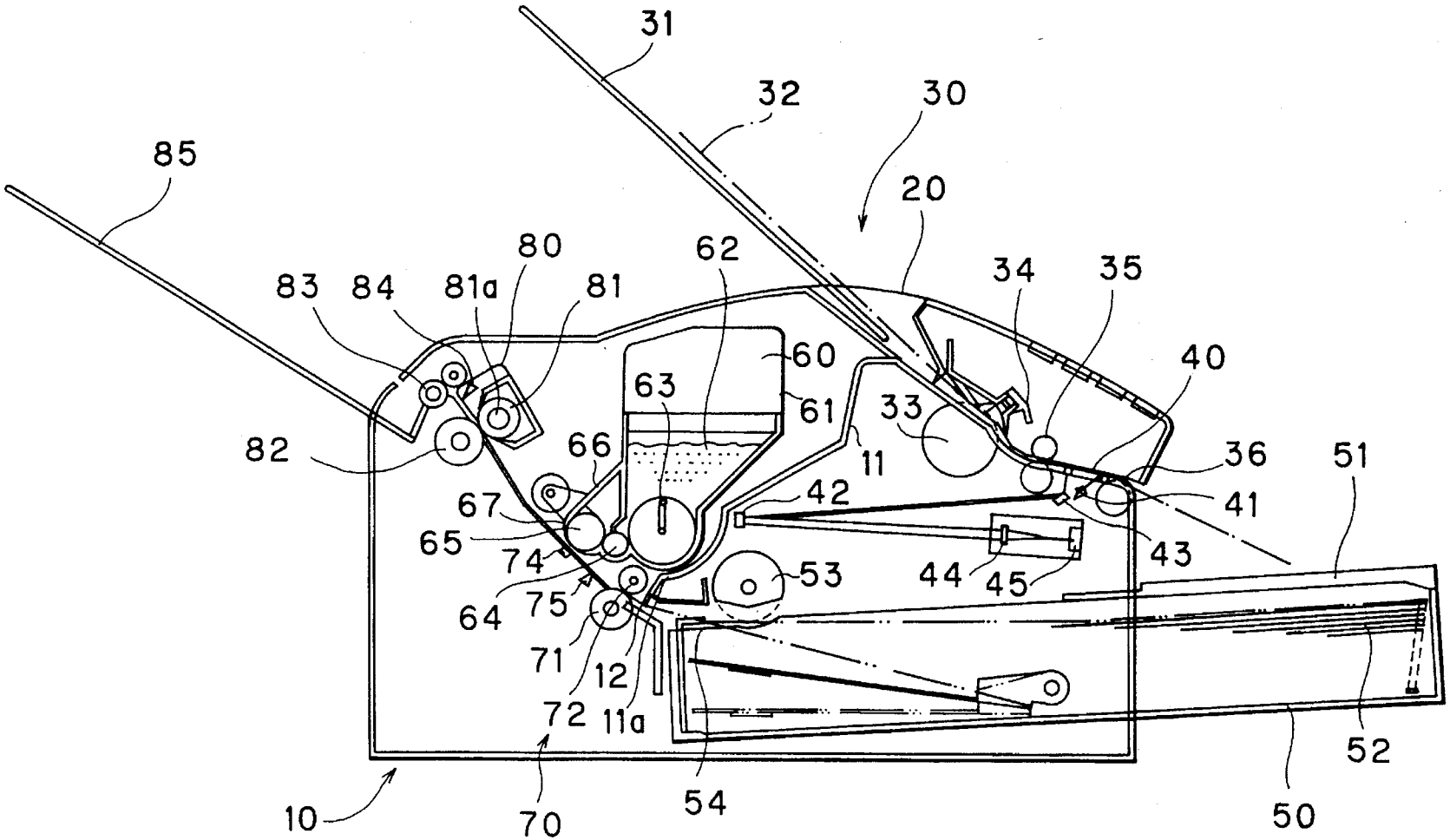
FIG. 1 is a cross-sectional view showing a facsimile machine according to a preferred embodiment of the present invention.

An image forming device according to a preferred embodiment of the present invention will be described while referring to the accompanying drawings wherein like parts and components are designated by the same reference numerals to avoid duplicating description.

FIG. 1 is a cross-sectional view of a facsimile machine according to the present invention. The facsimile machine includes a document supply system 30, a document reading system 40, and a document discharge system (36, 51) disposed along a document transport path.

The document supply system 30 includes a document tray 31, a paper supply roller 33, a separator 34, and a document transport roller 35. The document tray 31 is provided at the top of the facsimile machine at a downward slant. Several sheets of documents 32 to be transmitted can be stacked on the document tray 31 with the image surface (surface recorded with an image to be transmitted) facing downward. The document supply roller 33, the separator 34, and the document transport rollers 35 are disposed in order along the document transport path between the lower end of the document tray 31 and the document reading system 40.

The document reading system 40 includes a light emission diode (LED) 41, reflection mirrors 43 and 42, a focus lens 44, and a charge coupled device (CCD) 45. The reflection mirrors 43 and 42, the focus lens 44, and the charge coupled device (CCD) 45 are disposed along a path followed by light produced by the LED 41 and reflected off the document 32 in the document reading system 40.

The document discharge system includes a discharge roller 36 and a discharged document tray 51. The discharge roller 36 is provided adjacent to the document reading system 34 for picking up a read document 32 and discharging it from the facsimile machine. The discharged document tray 51, which is for receiving document sheets 32 discharged by the discharge roller 36, is provided to the top surface of a sheet supply cassette 50 provided at the base of the facsimile machine.

When a document is to be transmitted, the supply roller 33 and the separator 34 separate one document sheet 32 at a time from the stack and transport it toward the document transport roller 35. The document transport roller 35 picks up the separated document sheet 32 and transports it toward the document reading system 40. The image surface of the document sheet 32 is illuminated by the LED 41. The illumination light reflects off the image surface of the document sheet 32 toward the reflection mirrors 43 and 42. The reflection mirrors 43 and 42 reflect the light so it is incident on the CCD 45 after being focused by the focus lens 44. After being read, the document sheet 32 is discharged by the discharge roller 36 onto the discharge document tray 51.

The facsimile machine further includes a sheet supply system, a sheet transport system 70, a development process unit 60, a thermal fixing device 80, and a sheet discharge system all disposed along a sheet transport path followed by a sheet to be recorded on from the sheet supply cassette 50 of the sheet supply system to a discharged sheet tray 85 of the sheet discharge system.

The sheet supply system includes the sheet supply cassette 50, a supply roller 53, and a pair of claws 54 (only one of the pair of claws is shown in FIG. 1), all disposed in order along the sheet transport path. The sheet supply cassette 50 stores a stack of sheets of a predetermined size for receiving incoming images. The supply roller 53 is semicircular in cross section.

The facsimile machine is provided with a housing 10. A panel cover 20 is swingably attached to the housing 10 and so can be opened and closed. The housing 10 includes a curved partition 11 with a tip portion 11a. A charge removing brush 12 for removing charges from sheets 52 supplied from the sheet supply cassette 50 is fixed to the tip portion 11a of the partition 11.

The transport system 70 includes a pair of transport relay rollers 71 and 72 and a chute 73 (to be described later). The pair of relay rollers 71 and 72 are disposed adjacent to the development process unit 60 at opposite sides of the sheet transport path between the charge removing brush 12 and the development process unit 60. The pair of relay rollers 71 and 72 are rotatably supported about their axes, in the directions indicated by the arrows in FIG. 2, so that a sheet 52 with charge removed by the charge removing brush 12 is serially transported between the supply rollers 71 and 72 following a line L1 that is tangential to both relay rollers 71 and 72. Line L1 described while referring to the cross-sectional view shown in FIG. 2 would, in three-dimensional space, be a tangent plane of both relay rollers 71 and 72.

Figure 2:
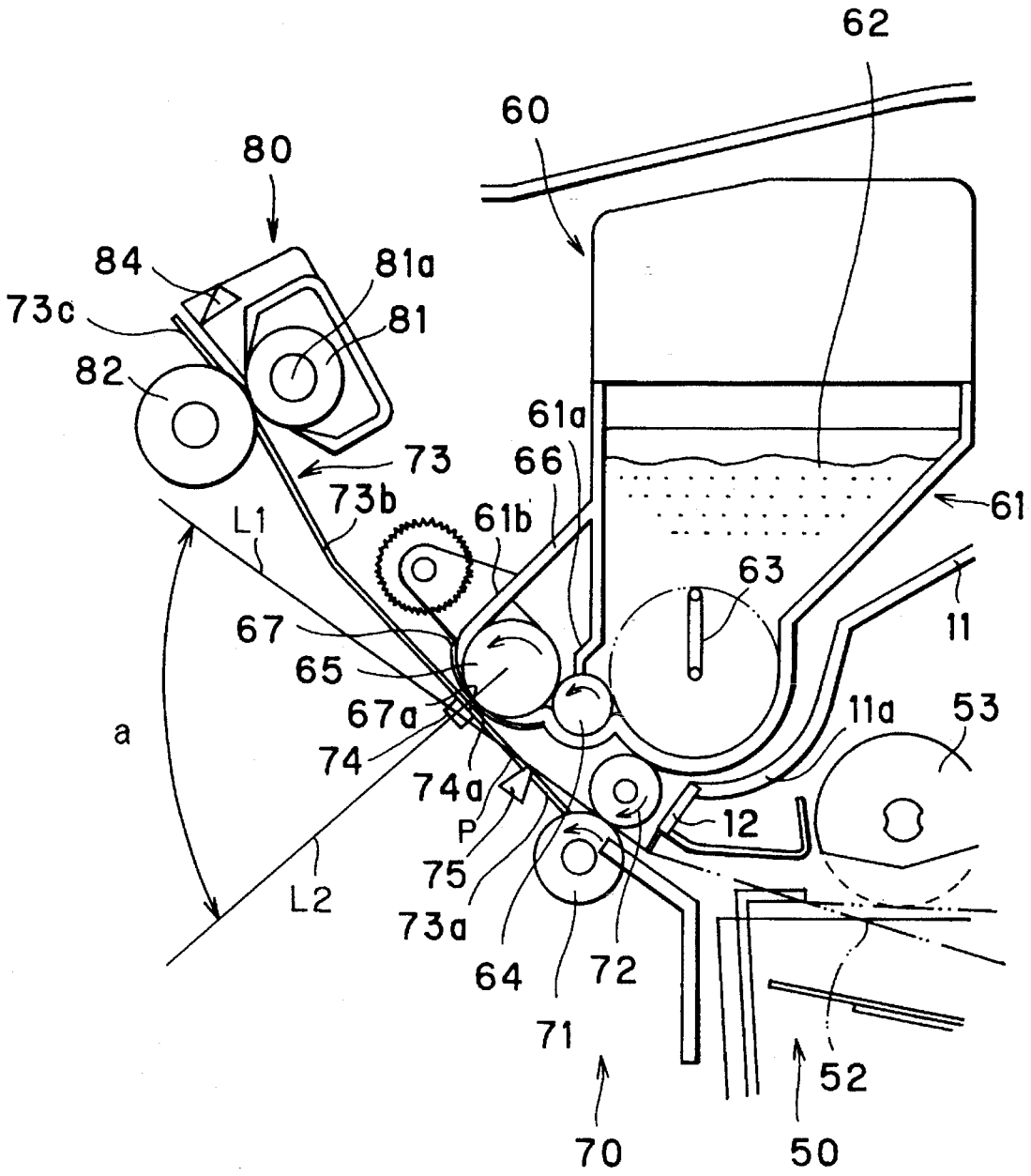
FIG. 2 is a cross-sectional view showing details of a development process unit of the facsimile machine shown in FIG. 1.

The development process unit 60 is similar to the image recording apparatuses described in detail in U.S. Pat. Nos. 5,229,794 and 5,231,427, the disclosures of which are herein incorporated by reference. As shown in FIGS. 1 and 2, the development process unit 60 includes a toner casing 61 positioned directly upstream (in regards to the direction a sheet moves in the sheet transport path) of the transport system 70 and the tip portion 11*a* of curved partition 11. Toner 62 fills the toner casing 61. An agitator 63 for preventing the toner from clumping is provided in the toner casing 61. A toner supply port 61*a* is formed in the lower left hand side (as viewed in FIG. 2) of the toner casing 61. A supply roller 64 is supported on its axis in the toner supply port 61*a* so as to be rotatable about its axis in the direction indicated by the arrow in the drawing.

A supplementary chamber 61*b* is provided adjacent to the toner supply port 61*a*. A toner bearing roller 65 is rotatably supported on its axis in the supplementary chamber 61*b* so as to contact the toner supply roller 64 while the toner bearing roller 65 and the toner supply roller 64 rotate. A toner layer regulating plate 66 is fixed to the inner wall of the supplementary chamber 61 for regulating the thickness of the toner layer on the surface of the toner bearing roller 65.

An elongated aperture electrode 67 is provided to the supplementary chamber 61*b* adjacent to the toner bearing roller 65 at one side of the sheet transport path. A plurality of apertures 67*a* are formed in the aperture electrode 67 so that the axes of the plurality of apertures 67*a* are parallel with each other. The aperture electrode 67 is positioned so that the axis of an aperture 67*a* is aligned with a line L2 that is perpendicular with the axis of the toner bearing roller 65. Although line L2 was described while referring to cross-sectional FIG. 2, in three-dimensional space the line L2 would be a plane substantially aligned with the axes of all the apertures 67*a* and passing through the axis of the toner bearing roller 65. The aperture electrode 67 is electrically connected to a control unit (not shown) for controlling the aperture electrode 67 according to a control voltage so as to draw toner from the toner bearing roller 65 toward and through desired apertures 67*a*.

The chute 73 of the transport system 70 is formed from three elongated sections: a first section 73*a*, a second section 73*b*, and a third section 73*c*. The first section 73*a* is a substantially planer plate supported between the relay rollers 71 and 72 and one side of line L2 so that if extended so as to intersect line L2 it would be perpendicular to line L2. The first section 73*a* is positioned so as to intersect line L1 at an intersection point P upstream from the aperture electrode 67, the first section 73*a* crossing in the downstream direction from one side of line L1 to the side of L1 on which the aperture electrode 67 is provided.

The second section 73*b* is supported between the other side of line L2 and the thermal fixing device 80. The third section 73*b* of the chute 73 is supported between the thermal fixing device 80 and the discharge sheet system. The first through third sections 73*a* through 73*b* can be, for example, three separate sections separately supported, three sections connected together, or one continuous piece with openings formed therein at the back electrode 74 and the thermal fixing unit 80. A tip sensor 75 for optically detecting the sheet and determining the timing for start of recording on the sheet is provided confronting the first section 73*a*.

Figure 3:
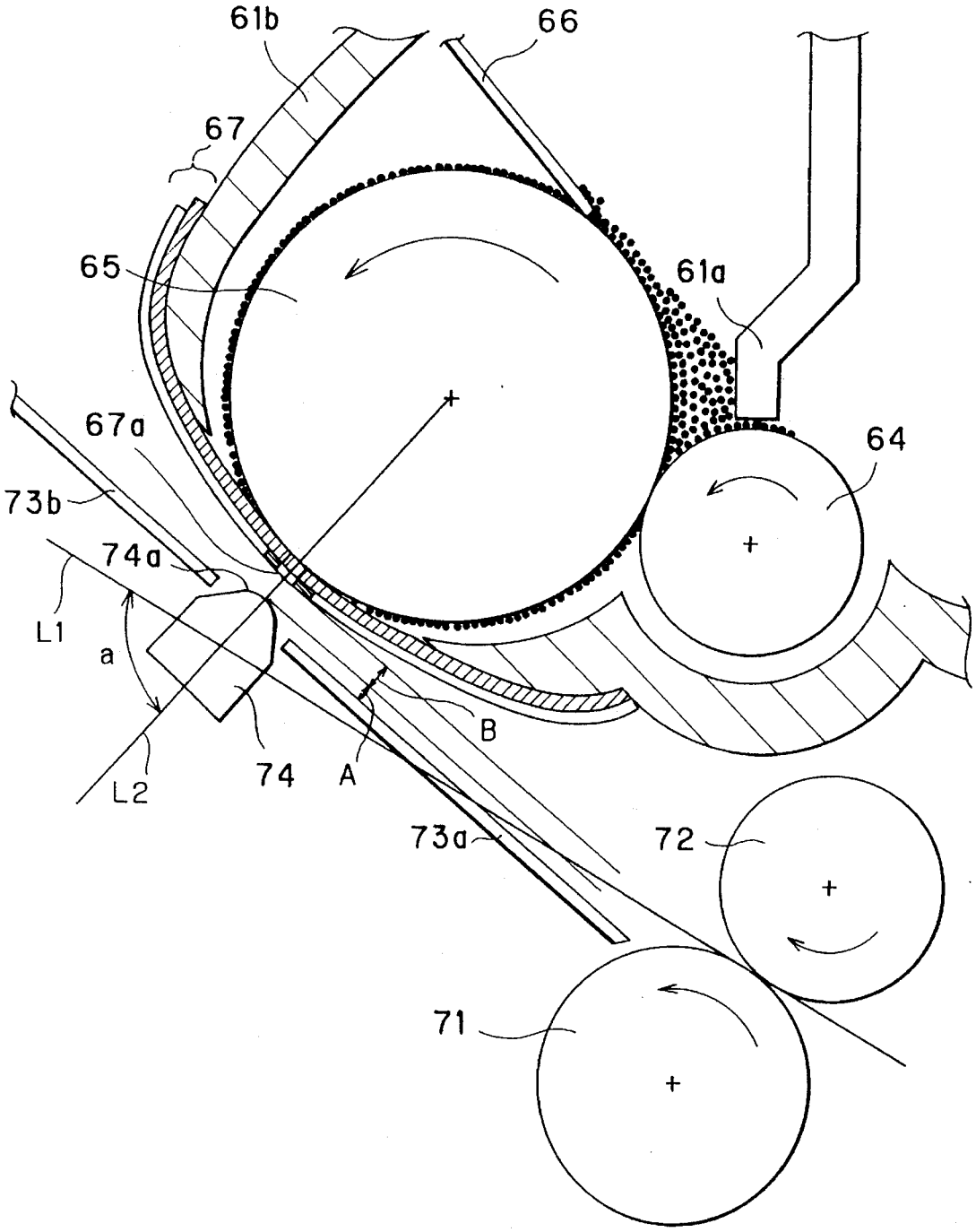
FIG. 3 is a cross-sectional view showing further details of the development process unit shown in FIG. 2.

A back electrode 74 is mounted between the first section 73*a* and the second section 73*b* so that its length runs parallel to the lengthwise direction of the aperture electrode 67. It should be noted that the lengthwise direction of the aperture electrode 67 and the back electrode 74 is the direction cut through to form the cross-sectional views shown in the diagrams. The back electrode 74 is supported on the side of the sheet transport path opposite the side on which the aperture electrode 67 is provided. The back electrode 74 is supported so that its electrode tip 74a confronts the apertures 67*a* of the aperture electrode 67 and cuts across the sheet transport path (as guided by the first section 73*a*) so as to protrude in the direction of the apertures 67*a* a distance A as shown in FIG. 3. In the present embodiment distance A is between 1.5 to 2.0 mm but other values are possible. The electrode tip 74*a* of the back electrode 74 and the aperture electrode 67 are separated by a space B shown in FIG. 3. In the present embodiment space B is about 0.5 mm wide although other values are possible. The back electrode 74 is positioned so that a line dividing its cross-sectional surface (see FIG. 3) is aligned with line L2.

The thermal fixing device 80 is positioned downstream from the development process unit 60. The thermal fixing device 80 includes a pressure spring (not shown), a pressure roller 82, and a heat roller 81 with an internal heater 81*a*. The heat roller 81 and the pressure roller 82 are rotatably provided so as to contact each other while rotating. The pressure spring is provided to as to press the pressure roller 82 against the heat roller 81.

The sheet discharge system includes a discharge sensor 84 and, as shown in FIG. 1, a discharge roller 83 and the discharged sheet tray 85.

The following is an explanation of an image recording operation of the facsimile machine according to the present embodiment. Rotation of the supply roller 53 draws the top sheet from the stack of sheets 52 stored in the cassette. One sheet at a time is separated from the stack by the pair of claws 54 and fed toward the pair of relay rollers 71 and 72. The relay rollers 71 and 72 transport the sheet 52 downstream in alignment with line L1.

The agitator 63 supplies toner 62 to the toner supply port 61*a*. Rotation of the toner supply roller 64 transports toner from the toner supply port 61*a* toward the toner bearing roller 65. Rotation of the toner bearing roller 65 scrapes toner off the surface of the toner supply roller 64 where the surface of the toner supply roller 64 and the surface of the toner bearing roller 65 contact. Rotation of the toner bearing roller 65 supplies toner to the apertures 67*a*.

The sheet 52 transported from the relay rollers 71 and 72 abuts the first section 73*a* of the chute 73 at point P. The resiliency or stiffness of the sheet 52 urges the sheet 52 in the direction of the first section 73*a*, that is, urges the sheet 52 to return to a path parallel with line L1, thereby forming the portion of the sheet 52 between the relay rollers 71 and 72 and point P on the first section 73*a* into an arc shape. The charge removing brush 12 removes any charge from the surface of the sheet 52 to be recorded on. The sheet 52 is guided by following the chute 73 until it reaches the position of the tip sensor 75. The tip sensor 75 detects the front edge of the sheet 52.

The first section 73*a* guides the sheet 52 to the back electrode 74. The sheet 52 first hits the back electrode 74. The sheet then passes over the back electrode 74 so as to pass between the back electrode 74 and the aperture electrode 67 while in firm contact with the back electrode 74.

When the front edge of the sheet 52 as determined by the tip sensor 75 has passed a predetermined distance past the tip electrode surface 74*a* of the back electrode 74 and the apertures 67*a* of the aperture electrodes 67, the aperture electrodes 67 are selectively energized by application of voltage according to an image signal from the control unit (not shown). The image signal can be generated according to, for example, an incoming signal from a remote facsimile machine or image information read from the document 32 by the document reading system 40. The toner is controllingly passed through the apertures 67*a* of the aperture electrode 67. Toner that passes through the apertures 67*a* is attracted by the electric field produced by the back electrode 74. The toner impinges on the sheet 52 to form an image thereon.

In this way an unfixed toner image is serially formed on the sheet 52 while it follows the chute 73 toward the thermal fixing unit 80. As mentioned above the angle a formed by lines L1 and L2 is less than 90°. Therefore the first section 73*a* intersects line L1 at point P so that the portion of the first section 73*a* upstream from the intersection point P is on one side of line L1 and the portion of the first section 73*a* downstream from intersection point P is on the other side of line L1. Because the sheet 52 is urged to return to a path parallel with line L1, the sheet 52 is urged against the second section 73*b*. The sheet 52 will therefore not come into contact with the aperture electrode 67 even if only a narrow space separates the opposing surfaces of the aperture electrode 67 and the electrode tip 74*a* of the back electrode 74. The unfixed toner image will therefore not be smudged. The resiliency from the arc does not allow the sheet 52 to touch the surface of the aperture electrode 67 and the sheet 52 is normally pressed on the electrode tip of the back electrode 74 as guided by following the chute 73.

The sheet 52 with a toner image formed thereon is guided by the second section 73*b* of the chute 73 toward the thermal fixing device 80. The toner image is thermally fixed by the heat roller 81 and the pressure roller 82. The sheet 52 with the fixed toner image is guided by the third section 73*c* of the chute 73 toward the discharge roller 83 and is discharged thereby onto the discharged sheet tray 85.

As described above, in the present invention the first section 73*a* of the chute 73 is provided so as to intersect line L1 at intersection point P. Therefore the first section 73*a* intersects line L1 at point P so that the portion of the first section 73*a* upstream from the intersection point P is on one side of line L1 and the portion of the first section 73*a* downstream from intersection point P is on the other side of line L1. Therefore even if only a narrow space separates the opposing surfaces of the aperture electrode 67 and the electrode tip 74*a* of the back electrode 74, the resiliency from the arc does not allow the sheet 52 to touch the surface of the aperture electrode 67. Because of this, and because the back electrode 74 is positioned in the path of a sheet guided by the first section 73*a*, the sheet 52 is pressed in good contact with the electrode tip 74*a* of the back electrode 74 when guided by the first section 73*a*. The surface of the sheet 52 with the unfixed toner will not touch the aperture electrode 67 and so will not smudge. As a result, quality of recorded images is stable without adding extra components and raising the cost of production.

Although the present invention has been described in detail with reference to a specific embodiment thereof, it would be apparent to those skilled in the art that various changes and modifications may be made therein without departing from the spirit of the invention.

For example, the preferred embodiment described the present invention used in a facsimile machine. However, the present invention can be used in other image forming devices as well, such as printers and plotters. Also the toner 62 was described as being a one component non-magnetic toner used in electrophotographic copy machines. However, other types of toner can be used, such as a single component magnetic toner or a toner with more than one component. Also a mesh type electrode can be used instead of the aperture electrode 67.

What is claimed is:

1. An image forming device, for forming an image on a sheet, comprising:

a pair of transport rollers rotatably supported so as to be rotatable in opposite directions, the pair of transport rollers for transporting the sheet therebetween by the rotation thereof so that the sheet exits from between the pair of rollers substantially aligned with a tangent plane of both of the pair of rollers;

an elongated chute having at least a chute section for guiding the sheet after the sheet exits from between the pair of transport rollers, the chute section having at opposite ends thereof a roller end and a back electrode end, the chute section being supported so as to intersect the tangent plane so that the roller end is on a first side of the tangent plane in confrontation with one of the pair of transport rollers and so that the back electrode end is on a second side of the tangent plane;

a toner control electrode supported on the second side of the tangent plane adjacent to the back electrode end of the chute section; and a back electrode having an electrode tip, the back electrode being supported adjacent to the back electrode end of the chute section so that the electrode tip is on the second side of the tangent plane, so that a distance between the electrode tip and the tangent plane is shorter than a distance between the toner control electrode and the tangent plane, and so that the electrode tip confronts the toner control electrode as separated by a space, the sheet being transported through the space as guided by the chute section.

2. An image forming device as claimed in claim 1 wherein the chute section defines a chute plane which is divided into a toner control electrode side and another side, the toner control electrode being supported in the toner control electrode side, and wherein the back electrode is supported so that the tip electrode cuts across the chute plane and protrudes into the toner control electrode side.

3. An image forming device as claimed in claim 2 wherein the tip electrode protrudes into the toner control electrode side by a distance of between 1.5 and 2.0 mm.

4. An image forming device as claimed in claim 2 wherein the toner control electrode is formed with a plurality of apertures, the apertures having axes, the apertures being aligned on a surface of the toner control electrode so that their axes define an axis plane that is perpendicular to the chute plane and that is perpendicular to a plane defined by the surface of the toner control electrode, an angle formed between the axis plane and the tangent plane being less than 90° and corresponding to a space that encompasses the back electrode end of the chute section.

5. An image forming device as claimed in claim 2 further comprising a toner supply roller supported adjacent to the toner control electrode for supplying toner thereto, the toner supply roller being supported at a side of the toner control electrode opposite a side at which the back electrode is supported, the toner supply roller having an axis through which an axis plane passes, the axis plane being perpendicular to the chute plane, an angle formed between the axis plane and the tangent plane being less than 90° and corresponding to a space that encompasses the back electrode end of the chute section.

6. An image forming device as claimed in claim 5 wherein the toner control electrode is formed with a plurality of apertures aligned on a surface of the toner control electrode, the surface of the toner control electrode defining a plane that is perpendicular to the axis plane.

7. An image forming device as claimed in claim 2 wherein the chute section and the tangent plane intersect upstream from the back electrode in regards to a direction the sheet is guided by the chute section.

8. An image forming device, for forming an image on a sheet, comprising:

a pair of transport rollers rotatably supported so as to be rotatable in opposite directions, the pair of transport rollers for transporting the sheet therebetween by the rotation thereof so that the sheet exits from between the pair of rollers substantially aligned with a tangent plane of both of the pair of rollers;

an elongated chute having at least a chute section for guiding the sheet after the sheet exits from between the pair of transport rollers, the chute section defining a chute plane which is divided space into a toner control electrode side and another side, the chute section having at opposite ends thereof a roller end and a toner control electrode end, the chute section being supported so that one of the pair of transport rollers is in confrontation therewith and another of the pair of transport rollers is in the toner control electrode side;

a toner control electrode supported adjacent to the toner control electrode end of the chute section and supported in the toner control electrode side, the toner control electrode being formed with a plurality of apertures, the apertures having axes, the apertures being aligned on a surface of the toner control electrode so that their axes define an axis plane that is perpendicular to the chute plane and that is perpendicular to a plane defined by the surface of the toner control electrode, an angle formed between the axis plane and the tangent plane being less than 90° and corresponding to a space that encompasses the toner control electrode end of the chute section; and a back electrode having an electrode tip, the back electrode being supported so that the electrode tip confronts the toner control electrode as separated by a space, the sheet being transported through the space as guided by the chute section.

9. An image forming device as claimed in claim 8 wherein the chute section and the tangent plane intersect upstream from the back electrode in regards to a direction the sheet is guided by the chute section.

10. An image forming device, for forming an image on a sheet, comprising:

a pair of transport rollers rotatably supported so as to be rotatable in opposite directions, the pair of transport rollers for transporting the sheet therebetween by the rotation thereof so that the sheet exits from between the pair of rollers substantially aligned with a tangent plane of both of the pair of rollers;

an elongated chute having at least a chute section for guiding the sheet after the sheet exits from between the pair of transport rollers, the chute section defining a chute plane which is divided into a toner control electrode side and another side, the chute section having at opposite ends thereof a roller end and a toner control electrode end, the chute section being supported so that one of the pair of transport rollers is in confrontation therewith and another of the pair of transport rollers is in the toner control electrode side;

a toner control electrode supported adjacent to the toner control electrode end of the chute section and supported in the toner control electrode side;

a back electrode having an electrode tip, the back electrode being supported so that the electrode tip confronts the toner control electrode as separated by a space, the sheet being transported through the space as guided by the chute section; and a toner supply roller supported adjacent to the toner control electrode for supplying toner thereto and supported in the toner control electrode side, the toner supply roller being supported at a side of the toner control electrode opposite a side at which the back electrode is supported, the toner supply roller having an axis through which an axis plane passes, the axis plane being perpendicular to the chute plane, an angle formed between the axis plane and the tangent plane being less than 90° and corresponding to a space that encompasses the back electrode end of the chute section.

11. An image forming device as claimed in claim 10 wherein the toner control electrode is formed with a plurality of apertures aligned on a surface of the toner control electrode, the surface of the toner control electrode defining a plane that is perpendicular to the axis plane.

12. An image forming device as claimed in claim 10 wherein the chute section and the tangent plane intersect upstream from the back electrode in regards to a direction the sheet is guided by the chute section.

* * * * *